US008777161B2

(12) United States Patent
Pollock et al.

(10) Patent No.: US 8,777,161 B2
(45) Date of Patent: Jul. 15, 2014

(54) LIGHTWEIGHT BLAST MITIGATING COMPOSITE PANEL

(75) Inventors: Clarence E Pollock, Reynoldsburg, OH (US); Mark J Perry, Hilliard, OH (US); John R Bush, New Albany, OH (US); Jeremy D Seidt, Columbus, OH (US); Michael L Fisher, Granville, OH (US)

(73) Assignee: Battelle Memorial Institute, Columbus, OH (US)

( * ) Notice: Subject to any disclaimer, the term of this patent is extended or adjusted under 35 U.S.C. 154(b) by 853 days.

(21) Appl. No.: 12/989,917

(22) PCT Filed: May 4, 2009

(86) PCT No.: PCT/US2009/042677

§ 371 (c)(1),
(2), (4) Date: Oct. 27, 2010

(87) PCT Pub. No.: WO2010/033266

PCT Pub. Date: Mar. 25, 2010

(65) Prior Publication Data

US 2011/0041679 A1 Feb. 24, 2011

Related U.S. Application Data

(60) Provisional application No. 61/071,516, filed on May 2, 2008, provisional application No. 61/071,517, filed on May 2, 2008.

(51) Int. Cl.
*B64C 1/00* (2006.01)

(52) U.S. Cl.
USPC ..... 244/121; 244/118.1; 89/36.01; 89/36.11

(58) Field of Classification Search
USPC ..... 244/118.1, 118.5, 121; 89/36.01, 36.02, 89/36.04, 36.11
See application file for complete search history.

(56) References Cited

U.S. PATENT DOCUMENTS

| | | | | |
|---|---|---|---|---|
| 6,241,187 | B1 * | 6/2001 | Apel et al. | 244/118.5 |
| 6,581,876 | B2 | 6/2003 | Cheung | |
| 2003/0080248 | A1 | 5/2003 | Morgan | |
| 2003/0114064 | A1 | 6/2003 | Fu et al. | |
| 2005/0188825 | A1 * | 9/2005 | Sharpe et al. | 86/50 |
| 2006/0189236 | A1 | 8/2006 | Davis et al. | |

FOREIGN PATENT DOCUMENTS

WO WO 2007/073055 12/2000

* cited by examiner

*Primary Examiner* — Timothy D Collins
*Assistant Examiner* — Nicholas McFall
(74) *Attorney, Agent, or Firm* — Diederiks & Whitelaw, PLC

(57) ABSTRACT

Lightweight blast mitigating composite panels (10) include a first glass composite shell (14; 152), an intermediate, preferably honeycomb layer (56; 156), a reinforcing layer (60; 160), an ultra high molecular weight polyethylene fiber (UHMWPE) layer (64; 164) and a second glass composite shell (15; 168) adhered together with fire resistant adhesive layers (54; 58, 63, 66; 154, 158, 163, 166). The UHMWPE layer (64; 164) includes top and bottom coatings (70, 71) of fire resistant thermoset plastic preferably in the form of a paste. The panels (10) have use in a wide range of applications including in a blast mitigating overhead storage bin (100). The storage bin (100) includes a main body portion (133) defining a storage area formed from composite unarmored and armored panel segments (137, 138; 128-132). The unarmored and armored panel segments (137, 138; 128-132) share first and second shells (14, 15) to form an integral main body portion, with the armored panel segments (128-132) providing blast protection between the storage area and a wall (125) of an airplane cabin (120).

26 Claims, 3 Drawing Sheets

LIGHTWEIGHT BLAST MITIGATING COMPOSITE PANEL

CROSS-REFERENCE TO RELATED APPLICATIONS

This application represents a National Stage application of PCT/US2009/042677 entitled "Lightweight Blast Mitigating Composite Panel" filed May 4, 2009, pending, which claims priority of U.S. Provisional Patent Application Ser. No. 61/071,516, filed May 2, 2008, entitled "Aircraft Overhead Storage Bin" and U.S. Provisional Patent Application Ser. No. 61/071,517, filed May 2, 2008 entitled "Lightweight Blast Mitigating Composite Panel".

STATEMENT REGARDING FEDERALLY SPONSORED RESEARCH OR DEVELOPMENT

The present invention was developed under TSA/TSL Contract No. DTFACT-03-C-00042. Therefore, the U.S. Government has certain rights to the invention.

BACKGROUND OF THE INVENTION

1. Field of the Invention

The present invention pertains to the art of protective panels and, more specifically, to lightweight blast mitigating composite panels.

2. Discussion of the Prior Art

Blast mitigation can be achieved by numerous methods including the use of structural elements such as composite armor. In general, composite armor comprises a system of materials in which ultra high molecular weight polyethylene (UHMWPE) fibers are arranged within a matrix to form a core that is subsequently encased in some form of outer shell such as ceramic or fiberglass. The core and shell may be further surrounded by a protective sleeve or case. A limiting factor of such armors is the ability of the UHMWPE fibers to delocalize or disperse a blast load over the matrix.

One area where blast mitigation is increasingly utilized is in transportation applications. It is an unfortunate fact that terrorist threats to public transportation have increased in recent times. Bombs of various sorts have been utilized by terrorists in a variety of situations and pose a particular threat to in-flight aircraft. Despite an increase in security procedures and the use of explosives detecting equipment, bombs have still occasionally found their way aboard aircraft. Bombs may be smuggled into an aircraft in carry-on luggage or other parcels that are stored and carried in the overhead storage bins of the aircraft. Because of regulatory requirements, as well as practical considerations, overhead storage bins have certain size and weight limitations.

Based on the above, there exists a need for a lightweight blast mitigating composite panel which is adapted to protect against damage from an explosion and constructed from materials which are cost-effective. In particular, there is seen to exist a need for a lightweight panel which can be utilized in overhead storage bins to protect against damage from an explosion from within the bin.

SUMMARY OF THE INVENTION

The present invention is directed to a lightweight blast mitigating composite panel. More specifically, a composite panel includes multiple layers incorporating ultra high molecular weight polyethylene (UHMWPE) fibers as a primary strength component, a honeycomb layer, flame resistant thermoset adhesive layers applied on either side of the UHMWPE layer, and a fiber reinforcing layer applied on either side of the flame resistant thermoset layers. These composite layers form a core which is then encased in an outer fiberglass shell. The flame resistant thermoset adhesive layers provide for increased adhesion between the UHMWPE core and the high strength reinforcing fibers. The overall combined layering results in a panel having increased dynamic stiffness and the ability to disperse/distribute localized blast loads. The panels have numerous applications, including in the manufacturing of blast mitigating storage bins for aircraft. More specifically, a blast mitigating storage bin of the present invention includes integrated unarmored and armored portions covered by continuous upper and lower shells. The storage bin is lightweight and can replace a standard overhead storage bin in the cabin of an aircraft with no outward change in appearance or function, while the overall combined layering results in a panel having increased dynamic stiffness and the ability to disperse/distribute localized blast loads.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
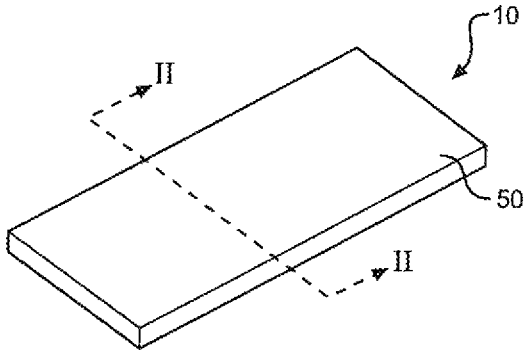
FIG. 1 is a perspective view of a lightweight blast mitigating composite panel of the present invention.

With initial reference to FIG. 1, a lightweight blast mitigating composite panel is generally indicated at 10. As will be detailed more fully below, panel 10 is constructed in a manner which provides for enhanced blast absorption, suppression and mitigation capabilities verses known composite panels employed for similar purposes. In general, panel 10 has various potential uses, including military, law enforcement, transportation and storm management fields.

Figure 2:
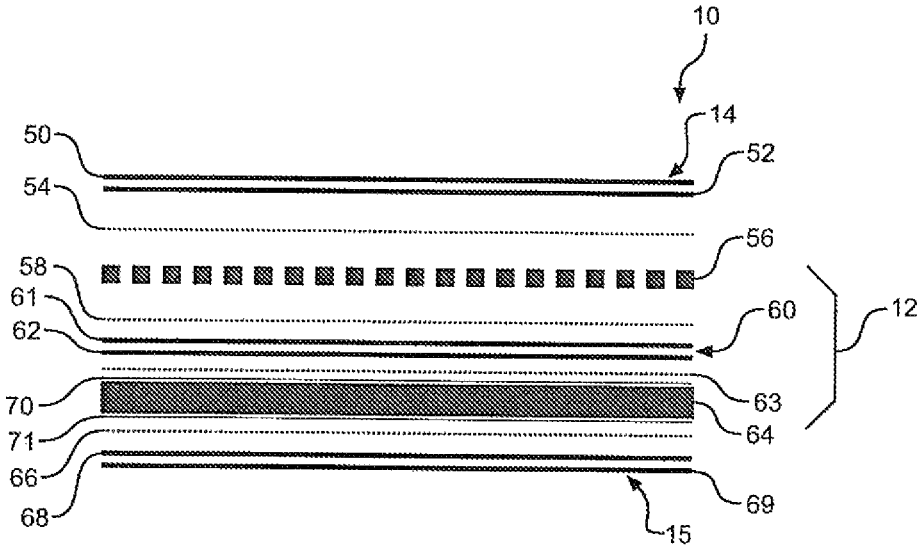
FIG. 2 is a representative cross-sectional view of the lightweight blast mitigating composite panel of FIG. 1.

Turning to FIG. 2, panel 10 incorporates ultra high molecular weight polyethylene (UHMWPE) fibers within a matrix to form a core 12 that is subsequently encased by first and second outer shells indicated at 14 and 15. Core 12 and shells 14 and 15 may be further surrounded by a protective sleeve or case (not shown).

More specifically, as depicted in FIG. 2, composite panel 10 includes outer shell 14 which is preferably comprised of reinforcing layers 50 and 52, a first flame-resistant adhesive layer 54, an intermediate, preferably honeycomb layer 56, a second flame-resistant adhesive layer 58, a first fiber reinforcing layer 60 comprised of reinforcing layers 61 and 62, a third flame-resistant adhesive layer 63, a UHMWPE layer 64, a fourth flame-resistant adhesive layer 66, and second outer shell 15 comprised of fiber reinforcing layers 68 and 69. In accordance with the invention, UHMWPE layer 64 is coated on each side with respective thermoset flame resistant plastic coating 70 and 71 in the form of a thin flame resistant paste. UHMWPE layer 64 is preferably Dyneema® or Spectra®, while honeycomb layer 56 is preferably Nomex®.

In accordance with the first embodiment, the lightweight armored panel of the present invention has the following characteristics: first outer shell 14 includes first and second reinforcing layers 50 and 52, each comprised of an E-glass/phenolic facing having a thickness of approximately 0.016 inches. Second outer shell 15 includes first and second fiber reinforcing layers 68 and 69 in the form of uni-directional carbon fiber/phenolic facings having a thickness of approximately 0.02 inches each. Likewise, first, interior reinforcing layer 60 includes first and second reinforcing layers 61 and 62 in the form of uni-directional carbon fiber/phenolic facings having a thickness of approximately 0.02 inches each. Flame resistant adhesive layer 54 extends between honeycomb layer 56 and first outer shell 14, and flame resistant adhesive layer 58 extends between honeycomb layer 56 and reinforcing layer 60. UHMWPE layer 64 includes thermoset flame resistant upper and lower plastic coatings 70 and 71, wherein layer 64 has an overall thickness in the order of 0.2 inches, most preferably approximately 0.214 inches. Additional flame resistant adhesive layers 63 and 66 having a thickness of approximately 0.005 inches adhere UHMWPE layer 64 to respective second outer shell 15 and first reinforcing layer 60. This first configuration results in a lightweight composite panel having an overall thickness in the order to 0.6-0.7 inches, preferably approximately 0.671 inches. Details of this first embodiment, which exhibits an advantageous strength to weight ratio, are summarized in Table 1 below.

TABLE 1

Material systems for armored segments

| System Designation | Material | Thickness (inch) |
|---|---|---|
| MLMC-F | 1583 E-glass/phenolic facing | 0.016 |
| | 1583 E-glass/phenolic facing | 0.016 |
| | L-310 phenolic adhesive | 0.005 |
| | Nomex ® honeycomb | 0.365 |
| | L-310 phenolic adhesive | 0.005 |
| | UNI carbon fiber/phenolic facing | 0.02 |
| | L-310 phenolic adhesive | 0.005 |
| | Dyneema ® HB25, 36 ply (w FR coating, Low Pressure Press) | 0.214 |
| | L-310 phenolic adhesive | 0.005 |
| | UNI carbon fiber/phenolic facing | 0.02 |
| | Total | 0.671 |

Figure 3:
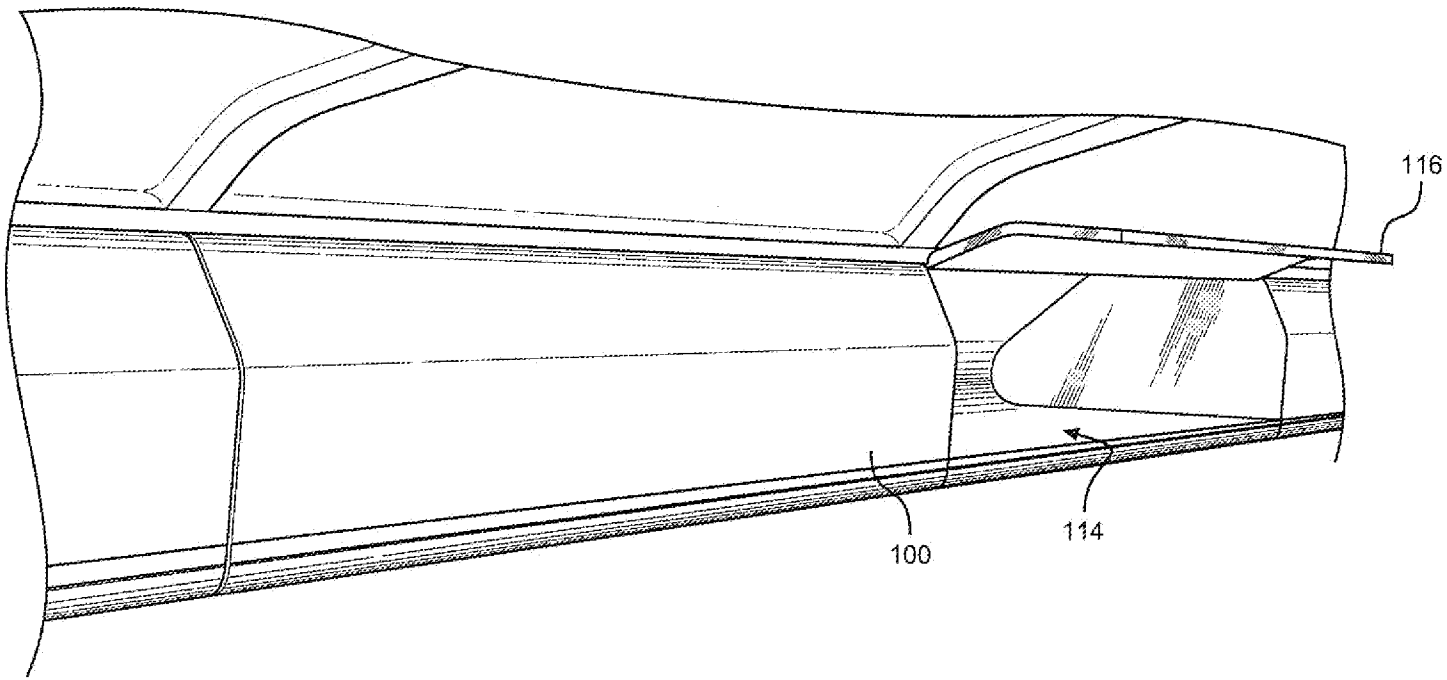
FIG. 3 is a perspective view of a hardened overhead luggage bin of the present invention.

One application of the lightweight blast mitigating panel 10 of the present invention is in the production of blast mitigating storage devices. With reference to FIG. 3, a blast mitigating overhead storage bin constructed in accordance with the present invention is indicated at 100. In general, storage bin 100 includes multiple storage compartments 114 and multiple hinged doors 116 adapted to seal the respective storage compartments 114. With reference to FIG. 4A, storage bin 100 is shown installed inside an aircraft cabin indicated at 120 in a manner known in the art, with a back outer wall 122 of storage bin 100 adjacent an inner wall 125 of aircraft cabin 120. Typical overhead storage bins are manufactured from lightweight composite materials which are vulnerable to explosive devices. As depicted in FIG. 4A, storage bin 100 incorporates blast-mitigating composite panels of the present invention in the form of armored panel segments 128-132, which provide sufficient ballistic and blast resistance to contain the effects of an explosive device. More specifically, storage bin 100 includes a main body portion 133 including an upper section 134, a back section 135, and a lower section 136 substantially parallel to upper section 134. In a preferred embodiment shown, upper section 134 is constituted by an unarmored top segment 137 and armored top panel segment 128. Similarly, lower section 136 is constituted by an unarmored bottom segment 138 and armored bottom panel segment 132, while back section 135 is constituted by armored panel segments 129-131. Each of the upper, back and lower sections 134-136 form an integral main body portion 133 as will be discussed in more detail below.

Figure 4B:
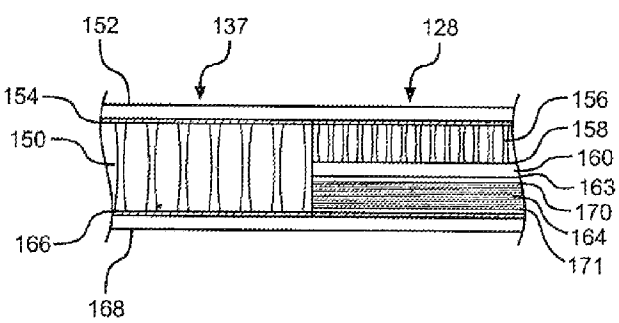
FIG. 4B is an enlarged cross-sectional view of a portion of the bin of FIG. 4A incorporating lightweight blast mitigating composite panels of the present invention.
Figure 4A:
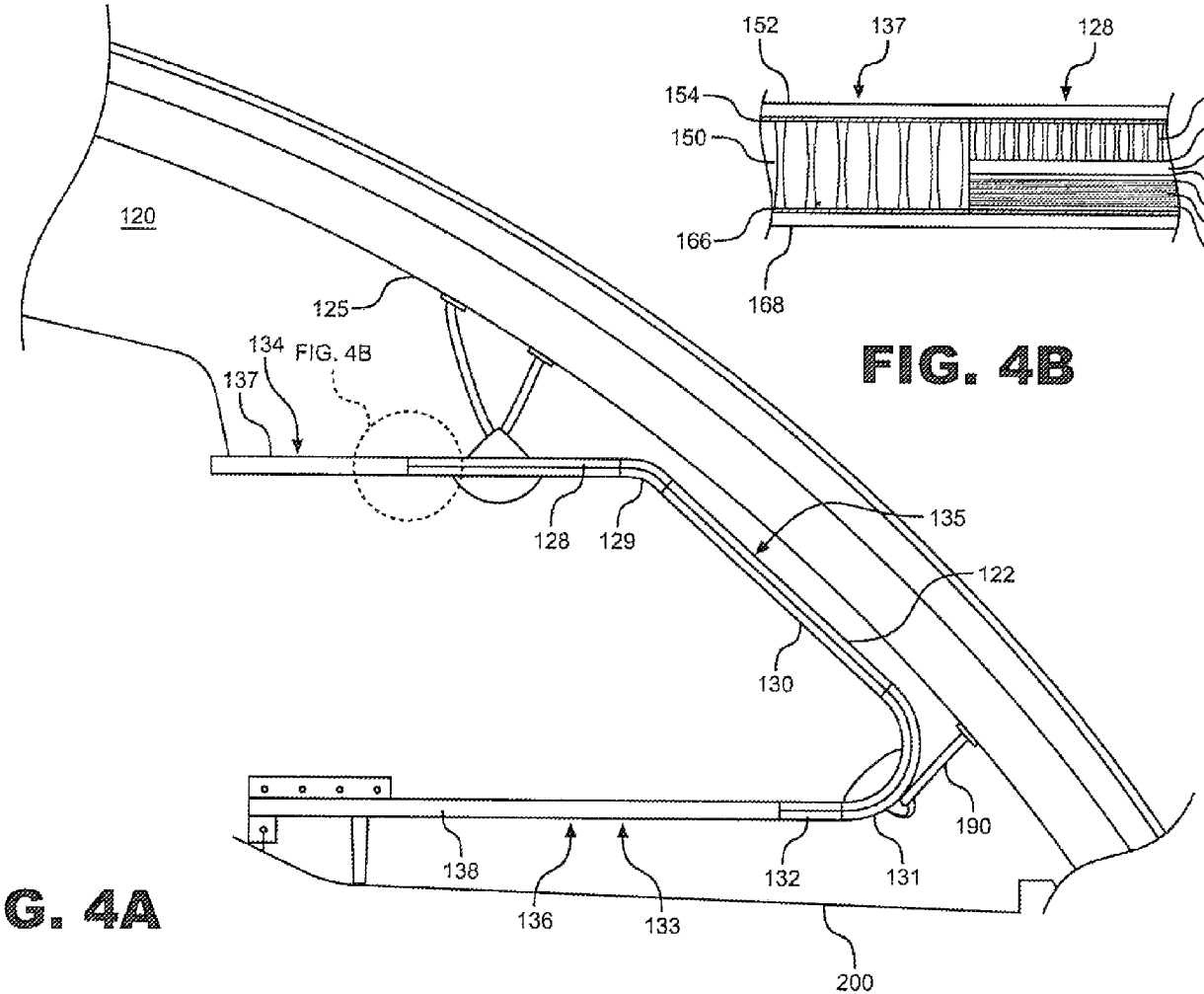
FIG. 4A is a partial cross-sectional side view of the bin of FIG. 3 without a door mounted thereon.

With particular reference to FIG. 4B, unarmored top and base segments 137 and 138 are preferably formed from composite materials typical of standard overhead storage bins. For example, unarmored top segment 137 is shown to include a core 150 of Nomex® honeycomb material, a first shell 152 of 1583 E-glass/phenolic facing adhered to core 150 with a fire or flame resistant adhesive 154 such as a L-310 phenolic adhesive film made by J. D. Lincoln, Inc., and a second shell 168 of S-glass phenolic prepreg adhered to core 150 with a flame resistant adhesive 166 such as a L-310 phenolic adhesive film. Armored panel segments 128-132 are integrally formed with unarmored top and base segments 137 and 138. More specifically, as demonstrated by unarmored top segment 137 and armored panel segment 128 in FIG. 4B, armored panel segment 128 includes the same first and second shells 152 and 168 as unarmored top segment 137. However, as depicted in FIG. 4B, the inner portion of armored panel segments 128-132 include a honeycomb layer 156, a first reinforcement layer 160 of S-glass phenolic prepreg, an ultra high molecular weight polyethylene (UHMWPE) fiber layer 164, a flame resistant thermoset plastic adhesive layer 163 between UHMWPE layer 164 and first reinforcement layer 160, and a flame resistant thermoset plastic adhesive layer 158 between honeycomb layer 156 and first reinforcement layer 160. Further, adhesive layer 154 extends between first shell 152 and honeycomb layer 156, while adhesive layer 166 extends between second shell 168 and UHMWPE layer 164.

In a preferred embodiment, UHMWPE fiber layer 164 is comprised of long chain polyethylene having molecular weights ranging from 3 to 6 million. However, in general, molecular weights above 500 thousand would be considered ultra high and functional in accordance with the invention. Still, a preferred molecular weight range is greater than 1 million and, most preferred is the 3-6 million weight range. In accordance with the present invention, UHMWPE layer 164 is coated on upper and lower sides with a fire resistant thermoset plastic coating indicated at 170 and 171 in the form of a thin flame resistant paste. Honeycomb layer 156 is preferably Nomex®.

Preferably, lightweight panel portions 128-132 utilized in blast mitigating overhead storage bin 100 include the following characteristics: first shell 152 comprises a single layer of E-glass/phenolic facing having a thickness of approximately 0.014 inches; flame resistant adhesive layers 154, 158, 163 and 166 comprise phenolic adhesive layers having a thickness of approximately 0.005 inches; and first fiber reinforcing layer 160 and second shell 168 comprise S-glass phenolic prepregs having a thickness of approximately 0.019 inches. In this embodiment, Nomex® honeycomb layer 156 has a thickness of approximately 0.365 inches and Dyneema® UHMWPE layer 164 has a thickness of approximately 0.156 inches, with each flame resistant thermoset coating 170 and 171 having a thickness of approximately 0.010 inches. This first configuration results in thin, armored sections 128-132, having an overall thickness of approximately 0.613 inches and an overall weight of approximately 1.59 lbs/ft$^2$. Details of this second, strong composite embodiment of the lightweight blast mitigating composite panels of the present invention are summarized in Table 2 below.

TABLE 2

Material System for armored segments.

| Material System | Thickness (inch) | Specific Weigh (lbs/ft2) |
|---|---|---|
| APF1114/1583 E-glass/phenolic | 0.014 | 0.1466 |
| L-310 phenolic adhesive (green film) | 0.005 | 0.0225 |
| APH1/8 3.0 lb Nomex ® honeycomb | 0.365 | 0.0913 |
| L-310 phenolic adhesive (green film) | 0.005 | 0.0225 |
| AGY S-glass Phenolic Prepreg | 0.019 | 0.1937 |
| L-310 phenolic adhesive (green film) | 0.005 | 0.0225 |
| FR Coating | 0.010 | 0.0404 |
| Dyneema ® | 0.1563 | 0.7966 |
| FR Coating | 0.010 | 0.0404 |
| L-310 phenolic adhesive (green film) | 0.005 | 0.0225 |
| AGY S-glass Phenolic Prepreg | 0.019 | 0.1937 |
| Total | 0.613 | 1.5926 |

Referring back to FIG. 4A, armored panel segments 128-132 are positioned such that inner wall 125 of aircraft cabin 120 will be protected from any blast originating inside storage compartments 114. Further, armored panel segments 128-132 protect attachment devices such as rackets, turnbuckles or attachment tie-rods 190, thereby preventing these components from becoming secondary fragments in the event of an explosion. Advantageously, storage bin 100 of the present invention may replace standard overhead luggage bins with, no outward change in appearance or storage function. Although storage bin 100 may have a slightly increased weight, the effects will be minimal. In a preferred embodiment, storage bin 100 has a capacity of greater than 1.75 to 2.0 pounds (lbs) per linear inch or 10 lbs per cubic foot, and includes a height of 12.10 to 13.14 inches, a bottom length of 25.59 to 30.63 inches and a top length of 11.40 to 15.15 inches. Passengers need not exert more than 50 lbs$_f$ to close a fully loaded bin 100 and 20 lbs$_f$ to open an empty bin 100, and storage bin 100 can withstand a hanging load of 300 lbs based on a passenger abuse test. Further, in accordance with standard requirements, storage bin 100 can be adapted to be utilized with passenger service units, such as a call button, lights, and the like (not shown) on an overhead panel 200. Vibration and fatigue of storage bin 100 does not interfere with the performance of the plane, particularly sensitive electronic parts. It should be noted that composite assemblies of different configurations (i.e., armored and non-armored) do not represent any additional difficulties in fabrication, production or assembly, keeping in mind that current bins are typically assembled from panels and are composed of panels of varying properties.

In accordance with the invention, it has been surprisingly found that the inclusion of the flame resistant thermoset plastic layers such as 70, 71 and 170, 171, dramatically enhances the blast absorption, suppression and mitigation capabilities of typical UHMWPE type shields by up to 4 times verses corresponding structure without the flame resistant thermoset plastic layers. Although the fire resistant layers' usual purpose is fire resistance, it is speculated that the fire resistant layers stiffen the Dyneema® layer enough to allow the stress created by a blast to disperse over a larger area. This may be due to the flame resistant thermoset plastic layers significantly enhancing the adherence of the composite layers to the UHMWPE layer core, be it Dyneema®, Spectra® or the like. In effect, this configuration increases the stiffness of the core material, which manifests itself into increased distribution of the localized loads resulting in significant improvements in blast performance. This system provides the core material with the required stiffness to absorb blast and ballistic threats. More specifically, composite panels including a coated UHMWPE core were found to perform well under both series 1 and series 2 tests under Section 2.1.2 (Fragmentation/Shock holing) of ISO 6517, Draft Appendix A, while standard panels known in the industry were found to perform at most under series 1 test requirements, as evidenced by the experimental results described below.

EXPERIMENTAL RESULTS

A total of eight sample panels were tested based on requirements set forth in the overhead bin specification Section 2.1.2 (Fragmentation/Shock holing) of ISO 6517, Draft Appendix A. The panels were tested under series 1 and series 2. The tests were conducted at Aberdeen Proving Grounds.

Test #1—Panel Composition No. 1, Series 1

A first 4'×4' panel had an identical composition and thickness to a standard hardened cockpit door supplied by C&D Aerospace, Inc. Specifically, the panel was composed of a 2-ply phenolic/E-glass facesheet, a film epoxy adhesive, a ⅜" Nomex® honeycomb panel treated with phenolic resin, a film epoxy adhesive, a UHMWPE—Dyneema® panel (3/16"), a film epoxy adhesive, and a 2-ply phenolic/E-glass facesheet. The panel was 1" thick and had an areal weight of 1.5 lb/sqft. The resin content was between 30-40% within the E-glass facing.

Test Procedure: The panel was mounted to a test fixture with 3 soft-sided suitcases, the charge suitcase was in the center. The contents, weight and composition of the charge bag and adjacent bags were documented to maintain consistency from test to test. Charge size and placement were in accordance with the requirements of overhead bin specification Section 2.1.2 of ISO 6517, Draft Appendix A, series 1. Instrumentation of the test was limited to still photograph documentation.

Test Results: Criteria for determining if a panel was deemed to have passed the test was a visual inspection of the panel post-test for signs of rupture at panel center due to impulsive loading. Panel pull-through at edges of bolted connections was not a criteria for shock hole failure. The panel did not perforate. On the outside panel, there was a tear in the 2 E-glass plies that measured 39" horizontally and 40" diagonally downwards. There were multiple tears between 15" and 41" to the E-glass (2 plies) and a 16"×18" hole in the honeycomb. On the inside panel, there was a 42" horizontal tear to the E-glass and a 10½"×18½" hole in the honeycomb. There was no hole in the Dyneema®. There was fragment damage to the inside face measuring 3"×3¼" and 2½×1½". There was minor charring to the panel and the dome deformation measured 4⅜". There was delamination near the center of the panel. The E-glass and honeycomb delaminated from the Dyneema®.

This panel passed under the requirements of overhead bin specification Section 2.1.2 (Fragmentation/Shockholing) of ISO 6517, Draft Appendix A, series 1.

Test #2—Panel Composition No. 1, Series 1

The panel submitted for test #2 was identical in construction and composition to the panel submitted in test #1.

Test Procedure: The panel was mounted in the test fixture and the bags were prepared and oriented identically to the manner used in test #1. The explosive charge weight, composition, initiation procedure and charge standoff were identical to the procedures noted in test #1.

Test Results: The panel did not perforate. On the outside panel, there was a tear that measured 30" horizontally and 37" vertically to the E-glass (2 plies). There were tears between 20" and 42" to the 2 plies of the E-glass and an 18" (horizontal)×11" (vertical) tear to the Nomex®. On the inside panel there was 30" (horizontal) and 37" (vertical) tears to the E-glass—2 plies and an 11" (horizontal)×8" (vertical) tear to the Nomex®. There was no hole in the Dyneema®. There was fragment damage to the inside face with a 1" hole and minor charring to the panel. The panel did not separate from the fixture. The dome deformation measured 2". There was delamination to the E-glass and honeycomb near the center of the panel.

This panel passed under the requirements to overhead bin specification Section 2.1.2 (Fragmentation/Shockholing) of ISO 6517, Draft Appendix A, series 1. By passing 2 successive series 1 tests, this panel design completely met series 1 shock hole requirements.

Test #3—Panel Composition No. 1, Series 2

The panel submitted for test #3 was identical in construction and composition to the panels submitted in tests #1 and #2.

Test Procedure: The panel was mounted in the test fixture and the bags were prepared and oriented identically to the manner used in tests #1 and #2.

Test Results: The panel perforated. On the outside panel, there were tears that measured between 44" and 16" to the E-glass (2 plies) and there was a 12"×11" hole in the honeycomb. On the inside panel there was a 17"×20" tear to the E-glass (2 plies) and a 12"×11" hole in the honeycomb. There was a hole in the Dyneema® that measured 6"×6". The panel did not separate from the fixture. There was also delamination near the central region. The panel did not burn and there was no fragment damage.

This panel failed under the requirements to overhead bin specification Section 2.1.2 (Fragmentation/Shockholing) of ISO 6517, Draft Appendix A, series 2.

Test #4—Panel Composition No. 2, Series 2

The panel submitted for test #4 was nearly identical in construction and composition to the panels submitted in tests 1-3, the only difference was the inclusion of a fire retardant (FR) layer placed on both sides and directly in contact with the Dyneema® layer. The FR layers were comprised of a thermosetting glue made by Composix in Newark, Ohio, having a thickness of approximately 0.060".

Test Procedure: The panel was mounted in the test fixture and the bags were prepared and oriented identically to the manner used in Tests 1-3.

Test Results: The panel did not perforate. On the outside panel, there was a tear in the 2-ply E-glass that measured 37" (horizontally) and 32" (vertically) and there was a 23"×15" hole in the honeycomb. On the inside panel there was a 9"×7" hole in the 2-ply E-glass and a 9"×12" hole in the Nomex®. There was delamination in the central region to the Dyneema®. The panel did not burn and there was no fragment damage. The dome deformation measured 1⅜".

This panel passed under the requirements to overhead bin specification Section 2.1.2 (Fragmentation/Shockholing) of ISO 6517, Draft Appendix A, series 2.

Test #5—Panel Composition No. 1, Series 2

The panel submitted for test #5 was identical in construction and composition to the panels submitted in tests 1-3.

Test Procedure: The panel was mounted in the test fixture and the bags were prepared and oriented identically to the manner used in tests 1-4.

Test Results: The panel perforated. On the outside panel, there were tears in the 2-ply E-glass that measured between 18" and 40" and a 9"×11" hole in the Nomex®. On the inside panel there was an 8"×10" hole in the 2-ply E-glass and an 8"×11" hole in the Nomex®. There was a 3"×2" hole in the Dyneema®. There was delamination in the central region to the E-glass and Nomex® from the Dyneema®. The dome deformation measured 4½". The panel did not burn and there was no fragment damage.

This panel failed under the requirements to overhead bin specification Section 2.1.2 (Fragmentation/Shockholing) of ISO 6517, Draft Appendix A, series 2.

Test #6—Panel Composition No. 3, Series 2

A 4'×4' panel sample was submitted having 6 plies composed of S2-glass/phenolic laminate, 0/90 layup. The panel was ⅛" thick and had an areal weight of 1.30 lb/sqft. The resin content was about 32%-35%.

Test Procedure: The panel was mounted to the test fixture with 3 soft-sided suitcases, the charge suitcase was in the center. The contents, weight and composition of the charge bag and adjacent bags were documented to maintain consistency from test to test. Charge size and placement were in accordance with the requirements to overhead bin specification Section 2.12 (Fragmentation/Shockholing) of ISO 6517, Draft Appendix A, series 1 and series 2. Instrumentation of the test was limited to still photograph documentation.

Test Results: Criteria for determining if a panel was deemed to have passed the test was a visual inspection of the panel post-test for signs of rupture at panel center due to impulsive loading. Panel pull-through at edges of bolted connections was not a criteria for shock hole failure. The panel perforated. On the outside and inside of the panel, there was delamination throughout most of the panel. There was a hole that measured 6" and all 6 plies were penetrated. There was no fragment damage and minor charring to the panel.

This panel failed under the requirements to overhead bin specification Section 2.1.2 (Fragmentation/Shockholing) of ISO 6517, Draft Appendix A, series 2.

Test #7—Panel Composition No. 3, Series 2

The panel submitted for test #6 was identical in construction and composition to the panel submitted in test #5.

Test Procedure: The panel was mounted in the test fixture and the bags were prepared and oriented identically to the manner used in test #5. The explosive charge weight, composition, initiation procedure and charge standoff were identical to the procedures noted in test #5.

Test Results: The panel perforated. There was delamination of 6 plies in and around the central hole and multiple tears extending inward from the bolt holes approximately 15" long. There was a hole that measured 5". There was one small fragment damage portion with partial penetration. There was also minor charring to the panel.

This panel failed under the requirements to overhead bin specification Section 2.1.2 (Fragmentation/Shockholing) of ISO 6517, Draft Appendix A, series 2.

Test #8—Panel Composition No. 3, Series 1

The panel submitted for test #7 was identical in construction and composition to the panels submitted in test #'s 5 and 6.

Test Procedure: The panel was mounted in the test fixture and the bags were prepared and oriented identically to the manner used in test #5 and #6.

Test Results: The panel perforated. There was delamination throughout the panel. There were multiple tears to the inside face extending inward form the bolt holes approximately 10". There was a hole that measured 9" vertically and 6" horizontally. There was no fragment damage and minor charring to the panel.

This panel failed under the requirements to overhead bin specification Section 2.1.2 (Fragmentation/Shockholing) of ISO 6517, Draft Appendix A, series 1.

Although described with reference to preferred embodiments of the invention, it should be readily understood that various changes and/or modifications can be made to the invention without departing from the spirit thereof. For instance, although main body portion 133 of overhead bin 100 is shown including five armored panel portions 128-132, it should be understood that various configurations utilizing different numbers of armored panels may be utilized without departing from the present invention. Additionally, although the disclosed embodiments refer to panels having a final thickness of approximately 0.613 and 0.671 inches, it should be understood that the general and specific thicknesses of each layer can be tailored to a desired application and the threat present in that particular application. Furthermore, although honeycomb layers 56, 156 are shown, honeycomb layers 56, 156 may not be necessary for every application of the armored panels of the present invention. Although S-glass and E-glass have been discussed above for use in the armored panel, other fiberglass products could be employed. Particularly preferred is S-2 Glass® made by AGY Holding Corporation.

Advantageously, the present invention provides a lightweight panel without the need for any metal, ceramic or other hard and difficult to process materials. The panel of the present invention can be shaped to limited curvatures and formed into components and panels to conform to existing configurations or replace existing structural panels. It should be readily understood that the armored panels of the present invention, in addition to having applications in baggage compartments and containers, can have applications including: military body or vehicle armor; homeland security, anti-terrorism and personal security fields; automotive, shipping and aerospace vehicles; and storm management. More specifically, the present invention may have use in load bearing structures, lightweight walls, explosive blow-out containment or mitigation walls or barriers in building construction, cargo applications, monuments, flooring, doors, and auxiliary panels, for example. In any case, the invention is only intended to be limited to the scope of the following claims.

What is claimed is:

1. A lightweight blast mitigating composite panel comprising:

a first glass composite shell;

an intermediate layer;

a first flame resistant adhesive layer interposed between and adhering the intermediate layer to the first glass composite shell;

a first reinforcing layer;

a second flame resistant adhesive layer interposed between and adhering the first reinforcing layer to the intermediate layer;

an ultra high molecular weight polyethylene fiber layer including an upper coating of fire resistant thermoset plastic and a lower coating of fire resistant thermoset plastic;

a third flame resistant adhesive layer interposed between and adhering the ultra high molecular weight polyethylene fiber layer to the first reinforcing layer;

a second glass composite shell; and a fourth flame resistant adhesive layer interposed between and adhering the ultra high molecular weight polyethylene fiber layer to the second glass composite shell.

2. The lightweight blast mitigating composite panel of claim 1, wherein the intermediate layer constitutes a honeycomb layer.

3. The lightweight blast mitigating composite panel of claim 1, wherein the first glass composite shell is constituted by an E-glass and phenolic composite.

4. The lightweight blast mitigating composite panel of claim 1, wherein the first reinforcing layer is constituted by an S-glass and phenolic composite.

5. The lightweight blast mitigating composite panel of claim 1, wherein the panel has a thickness in the order of 0.6 inches.

6. The lightweight blast mitigating composite panel of claim 1, wherein the first glass composite shell is constituted by two E-glass and phenolic composite sheets.

7. The lightweight blast mitigating composite panel of claim 6, wherein the first reinforcing layer is in the form of a uni-directional carbon fiber and phenolic facing.

8. The lightweight blast mitigating composite panel of claim 1, wherein:

the intermediate layer is directly adhered to the first glass composite shell;

the first reinforcing layer is directly adhered to the intermediate layer;

the ultra high molecular weight polyethylene fiber layer is directly adhered to the first reinforcing layer; and the ultra high molecular weight polyethylene fiber layer is directly adhered to the second glass composite shell.

9. The lightweight blast mitigating composite panel of claim 1 wherein:

the first reinforcing layer is formed of a material different from the ultra high molecular weight polyethylene fiber layer.

10. A blast mitigating storage bin for an aircraft comprising:

a main body portion including an upper section, a back section and a lower section, wherein the upper section, back section and lower section define a storage area, and wherein the main body portion is constituted by at least a first unarmored panel and a first lightweight blast mitigating composite panel, the first lightweight blast mitigating composite panel including:

a first glass composite shell;

an intermediate layer;

a first flame resistant adhesive layer interposed between and adhering the intermediate layer to the first glass composite shell;

a first reinforcing layer;

a second flame resistant adhesive layer interposed between and adhering the first reinforcing layer to the intermediate layer;

an ultra high molecular weight polyethylene fiber layer including an upper coating of fire resistant thermoset plastic and a lower coating of fire resistant thermoset plastic;

a third flame resistant adhesive layer interposed between and adhering the ultra high molecular weight polyethylene fiber layer to the first reinforcing layer;

a second glass composite shell; and a fourth flame resistant adhesive layer interposed between and adhering the ultra high molecular weight polyethylene fiber layer to the second glass composite shell.

11. The blast mitigating storage bin of claim 10, wherein the intermediate layer constitutes a honeycomb layer.

12. The blast mitigating storage bin of claim 10, wherein the first glass composite shell is constituted by an E-glass and phenolic composite.

13. The blast mitigating storage bin of claim 10, wherein the first reinforcing layer is constituted by an S-glass and phenolic composite.

14. The blast mitigating storage bin of claim 10, wherein first lightweight blast mitigating composite panel has a thickness in the order of 0.6 inches.

15. The blast mitigating storage bin of claim 10, wherein the first glass composite shell is constituted by first and second E-glass and phenolic composite sheets.

16. The blast mitigating storage bin of claim 15, wherein the first reinforcing layer is constituted by a uni-directional carbon fiber and phenolic facing.

17. The blast mitigating storage bin of claim 10, wherein the first unarmored panel comprises a honeycomb layer interconnected between the first and second glass composite shells such that the first and second glass composite shells are common to the unarmored panel and the first lightweight blast mitigating composite panel.

18. The blast mitigating storage bin of claim 17, wherein the honeycomb layer is affixed to the first and second glass composite shells by the first and fourth flame resistant adhesive layers respectively.

19. The blast mitigating storage bin of claim 10, wherein the main body portion additionally comprises second and third lightweight blast mitigating composite panels constructed as the first lightweight blast mitigating composite panel.

20. The blast mitigating storage bin of claim 19, wherein the first lightweight blast mitigating composite panel defines part of the upper section of the main body portion, the second lightweight blast mitigating composite panel defines at least part of the back section of the main body portion, and the third lightweight blast mitigating composite panel defines part of the lower section of the main body portion such that the first, second and third lightweight blast mitigating composite panels provide blast protection between the storage area of the main body portion and a wall of an airplane when the storage bin is mounted to a wall of an airplane.

21. The blast mitigating storage bin of claim 10, further comprising at least one attachment device connected to an outer wall of the main body portion at the first lightweight blast mitigating composite panel such that the attachment device is protected by the first lightweight blast mitigating composite panel from any explosion originating in the storage area of the storage bin.

22. A method of forming a lightweight blast mitigating panel comprising:

adhering a first glass composite shell layer to an intermediate layer with a first flame resistant adhesive layer interposed between the first glass composite shell layer and the intermediate layer;

adhering a first reinforcing layer to the intermediate layer with a second flame resistant adhesive layer interposed between the first reinforcing layer and the intermediate layer;

adhering an ultra high molecular weight polyethylene fiber layer including an upper coating of fire resistant thermoset plastic and a lower coating of fire resistant thermoset plastic to the first reinforcing layer with a third flame resistant adhesive layer interposed between the ultra high molecular weight polyethylene fiber layer and the first reinforcing layer; and adhering a second glass composite shell layer to the ultra high molecular weight polyethylene fiber layer with a fourth flame resistant adhesive layer interposed between the second glass composite shell layer and the ultra high molecular weight polyethylene fiber layer.

23. The method of claim 22, further comprising: providing the intermediate layer as a honeycomb layer.

24. The method of claim 22, further comprising: forming a blast mitigating aircraft overhead storage bin by creating a main body portion including an upper section, a back section and a lower section, wherein the upper section, back section and lower section define a storage area and wherein the main body is constituted by at least a first unarmored panel and the lightweight blast mitigating panel.

25. The method of claim 22, wherein:

adhering the first glass composite shell layer to the intermediate layer includes directly adhering the first glass composite shell layer to the intermediate layer;

adhering the first reinforcing layer to the intermediate layer includes directly adhering the first reinforcing layer to the intermediate layer;

adhering the ultra high molecular weight polyethylene fiber layer to the first reinforcing layer includes directly adhering the ultra high molecular weight polyethylene fiber layer to the first reinforcing layer; and adhering the second glass composite shell layer to the ultra high molecular weight polyethylene fiber layer includes directly adhering the second glass composite shell layer to the ultra high molecular weight polyethylene fiber layer.

26. The method of claim 22, wherein adhering the first reinforcing layer to the intermediate layer includes adhering the first reinforcing layer, formed of a material different from the ultra high molecule weight polyethylene fiber layer, to the intermediate layer.

* * * * *